US007588247B2

(12) United States Patent
Aoki

(10) Patent No.: US 7,588,247 B2
(45) Date of Patent: Sep. 15, 2009

(54) DELIVERY DEVICE IN SHEET-FED OFFSET ROTARY PRINTING PRESS

(75) Inventor: Takanobu Aoki, Ibaraki (JP)

(73) Assignee: Komori Corporation, Tokyo (JP)

( * ) Notice: Subject to any disclaimer, the term of this patent is extended or adjusted under 35 U.S.C. 154(b) by 237 days.

(21) Appl. No.: 11/520,508

(22) Filed: Sep. 12, 2006

(65) Prior Publication Data

US 2007/0052158 A1 Mar. 8, 2007

(30) Foreign Application Priority Data

Sep. 14, 2005 (JP) ..... 266585/2005

(51) Int. Cl.
*B65H 29/68* (2006.01)

(52) U.S. Cl. ..... 271/183

(58) Field of Classification Search ..... 271/183, 271/182; 101/240, 279
See application file for complete search history.

(56) References Cited

U.S. PATENT DOCUMENTS 3,081,082 A * 3/1963 Spooner et. al. ..... 271/183
3,791,269 A * 2/1974 Sawada ..... 271/258.01
4,221,377 A 9/1980 Bodewein et al.
4,830,355 A * 5/1989 Jeschke ..... 271/183
7,210,679 B2 * 5/2007 Schafer et al. ..... 271/183
7,275,742 B2 * 10/2007 Schafer et al. ..... 271/182
2004/0124579 A1 7/2004 Schafer et al.
2005/0067761 A1 * 3/2005 Schafer et al. ..... 271/183

FOREIGN PATENT DOCUMENTS

JP 2000-095409 A 4/2000

* cited by examiner

*Primary Examiner*—David H Bollinger
(74) *Attorney, Agent, or Firm*—Blakely, Sokoloff, Taylor & Zafman LLP

(57) ABSTRACT

A delivery device in a sheet-fed offset rotary printing press includes a plurality of suction units and at least one guide unit. The plurality of suction units are arranged above a pile board on an upstream sheet convey direction side below a sheet under conveyance in a widthwise direction of the sheet, and draw by suction the sheet under conveyance in slidable contact with it. The guide unit is arranged between suction units among the plurality of suction units which are located at two ends, and moves the sheet at substantially the same speed as a convey speed of the sheet under conveyance.

25 Claims, 13 Drawing Sheets

DELIVERY DEVICE IN SHEET-FED OFFSET ROTARY PRINTING PRESS

BACKGROUND OF THE INVENTION

The present invention relates to a delivery device in a sheet-fed offset rotary printing press, which is arranged on the upstream sheet convey direction side of a pile board and comprises a suction unit for decreasing a sheet convey speed.

In a sheet-fed offset rotary printing press of this type, a sheet printed by a printing unit is conveyed as it is gripping-changed from the grippers of an impression cylinder to the grippers of delivery chains. After that, the sheet is released from the grippers at the convey terminal end and drops onto a pile board to be stacked there. Since the sheet conveyed by the delivery chains is gripped by the grippers only at its leading edge, the trailing edge of the sheet may flutter. Also, when the sheet is released to drop, an inertia occurs as the sheet travels, and the edge of the sheet may not be aligned when stacked.

In order to prevent this, a plurality of suction wheels line up below the sheet under conveyance on the upstream sheet convey direction side of the pile board in the widthwise direction of the sheet. The suction wheels have suction surfaces which draw the sheet by suction in slidable contact with it and rotate at a peripheral speed lower than the sheet convey speed. Thus, the traveling speed of the released sheet that has been gripped by the grippers is decreased. In double-sided printing, if the suction wheels described above are located within a pattern printed on the reverse surface of the sheet, the suction surfaces of the suction wheels damage the image portions printed on the sheet to degrade the printing quality. Hence, the suction wheels must be located in non-image portions which are not printed.

If non-image portions do not exist other than the two ends of the sheet in the widthwise direction or the number of non-image portions is small, the number of suction wheels is limited, and the center of the sheet becomes slack between the suction wheels, that is, so-called middle slack occurs. When such middle slack occurs, the two ends of the sheet may be disengaged from the suction wheels and are not drawn by them by suction, so the sheet convey speed cannot be sufficiently decreased. As a result, the sheet flutters. When the sheet is stacked, the edge of the sheet is not aligned well, and comes into contact with the brackets of the suction wheels to damage the printing surface.

In order to solve this, an apparatus is proposed as shown in Japanese Patent Laid-Open No. 2000-95409, which comprises a plurality of suction wheels which are arranged in the widthwise direction of a sheet to be conveyed, and at least a pair of nozzles which are arranged below the sheet on the two sides of the sheet to sandwich the center of the sheet in the widthwise direction. The pair of nozzles discharge air to blow upward the sheet under conveyance. In this apparatus, the air discharge directions from the nozzles are directed outwardly in the widthwise direction of the sheet to correct the middle slack, in which the sheet becomes slack downward, by an air layer formed by air from the nozzles. Thus, the two ends of the sheet are not disengaged from the suction wheels.

In the suction device of the conventional sheet-fed offset rotary printing press, air is blown to the sheet to pull the two ends of the sheet outwardly in the widthwise direction, thus stretching the sheet tightly. To lift the sheet not partially but entirely uniformly, the air blowing amount must be adjusted. It is, however, difficult to adjust the air blowing amount, and this adjustment takes time. In order to prevent middle slack of the sheet, nozzles must be provided in addition to the suction wheels. Accordingly, a hose which supplies discharge air to the nozzles is necessary in addition to a hose that supplies suction air to the suction wheels. This leads to a complicated structure and increases the manufacturing cost.

SUMMARY OF THE INVENTION

It is an object of the present invention to provide a delivery device in a sheet-fed offset rotary printing press, in which the air blowing amount need not be adjusted when preventing middle slack of a sheet to be delivered.

It is another object of the present invention to provide a delivery device in a sheet-fed offset rotary printing press, in which the structure is simplified to decrease the manufacturing cost.

In order to achieve the above objects, according to the present invention, there is provided a delivery device in a sheet-fed offset rotary printing press, comprising a plurality of suction units which are arranged above a pile board on an upstream sheet convey direction side below a sheet under conveyance in a widthwise direction of the sheet and which draw by suction the sheet under conveyance in slidable contact therewith, and at least one guide unit which is arranged between suction units among the plurality of suction units which are located at two ends and move the sheet at substantially the same speed as a convey speed of the sheet under conveyance.

DESCRIPTION OF THE PREFERRED EMBODIMENT

A delivery device for a sheet-fed offset rotary printing press according to the first embodiment of the present invention will be described with reference to FIGS. 1 to 11.

Figure 1:
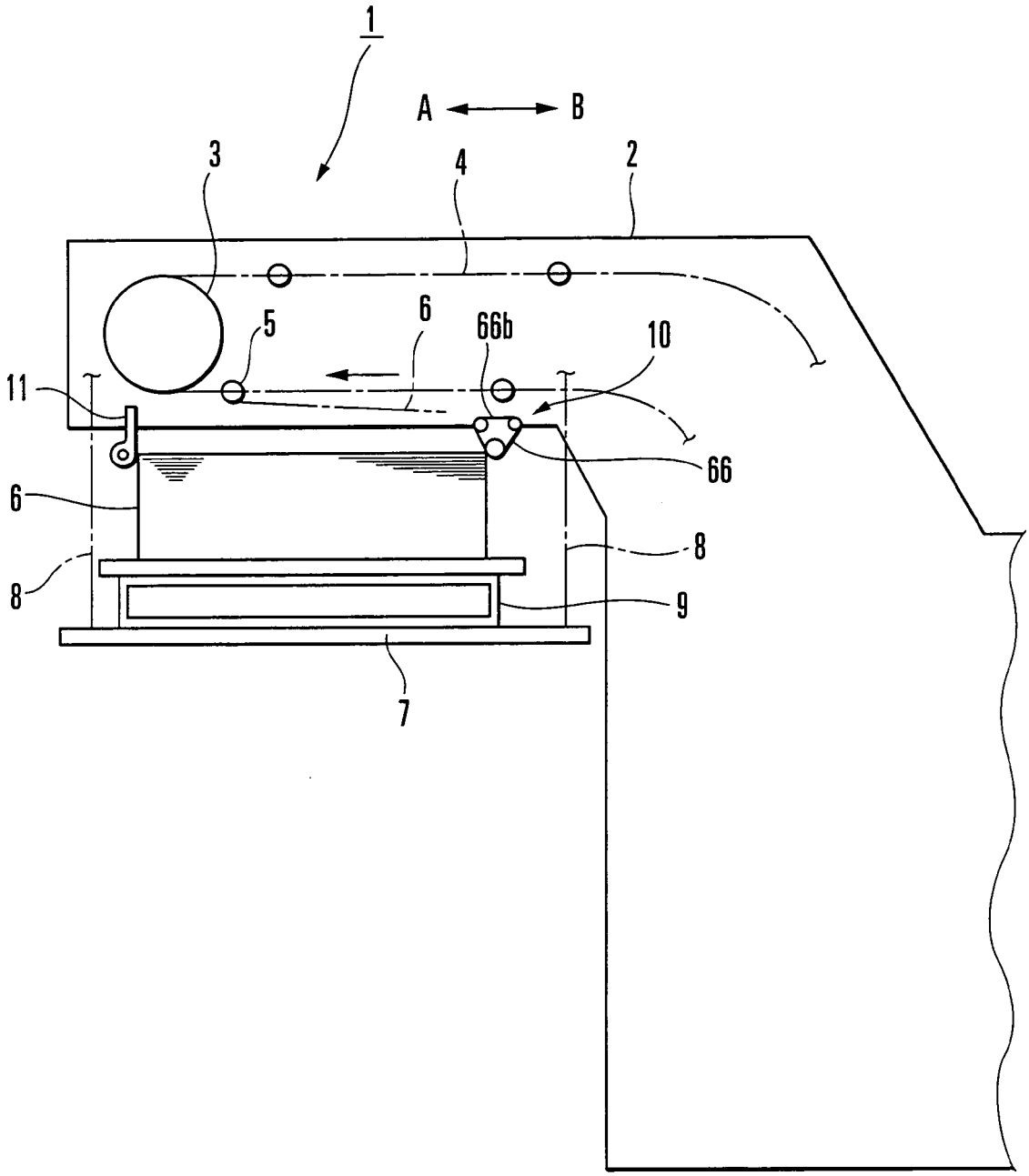
FIG. 1 is a side view schematically showing a delivery device in a sheet-fed offset rotary printing press according to the first embodiment of the present invention.

Referring to FIG. 1, a delivery device 1 for a sheet-fed offset rotary printing press comprises a pair of delivery frames 2 which oppose each other at a predetermined gap. The delivery frames 2 axially support a pair of sprockets 3. A pair of delivery chains 4 are looped between the pair of sprockets 3 of the delivery frames 2 and a pair of printing unit-side sprockets (not shown). A plurality of sets of gripper units 5 (schematically shown in FIG. 1) comprising grippers and gripper pads line up on each of gripper bars supported between the pair of delivery chains 4 at predetermined intervals. After printing, a sheet 6 which is gripped by the gripper units 5 and conveyed as the delivery chains 4 travel is released from the gripper units 5 and drops on the upstream sheet convey direction side of the sprockets 3.

Figure 3:
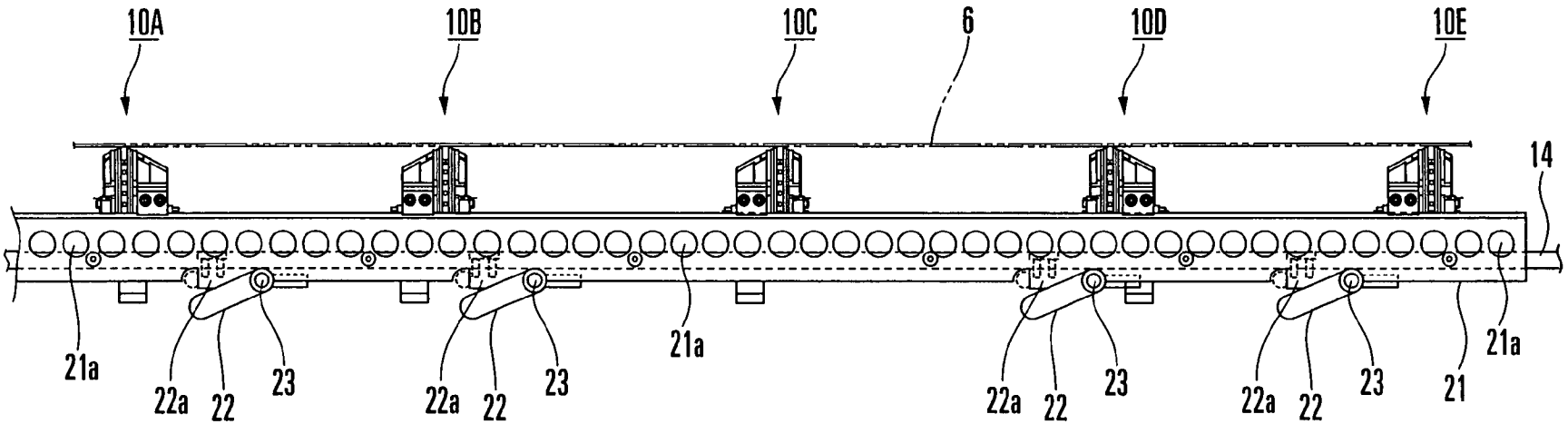
FIG. 3 is a front view of the main part of the delivery device shown in FIG. 1.

A pile board 7 with four corners suspended by four elevating chains 8 moves vertically when a motor (not shown) rotates clockwise/counterclockwise. A flat rectangular parallelepiped pallet 9 having a hole where the forks of a fork lift or the like can be inserted is placed on the pile board 7. On the upstream sheet convey direction (a direction of an arrow B) side of the pile board 7, five suction units 10A to 10E comprising belt type suction wheels arranged below the sheet 6 under conveyance line up in the widthwise direction (directions of arrows C and D) of the sheet 6 under conveyance, i.e., in a direction perpendicular to the convey direction (directions of an arrow A and the arrow B) of the sheet 6, as shown in FIG. 3. A sheet lay 11 abuts against the leading edge of the dropping sheet 6 to align it.

Figure 2:
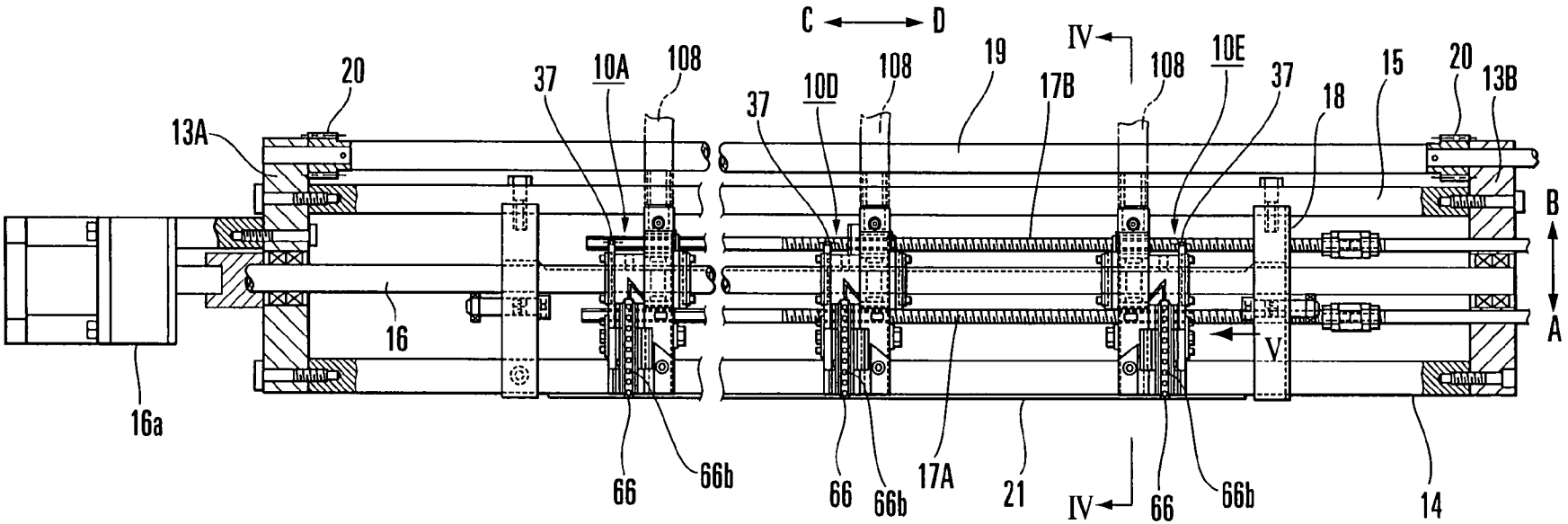
FIG. 2 is a plan view of the main part of the delivery device shown in FIG. 1

As shown in FIG. 2, a pair of subframes 13A and 13B are arranged to oppose each other at a predetermined gap in the directions of the arrows C and D, and two stays 14 and 15 horizontally extend between the subframes 13A and 13B. A driving shaft 16 is rotatably supported between the subframes 13A and 13B and rotatably driven by a motor 16*a* (first driving source). One subframe 13B and a support stay 18 which is attached between the stays 14 and 15 rotatably support screw shafts 17A and 17B. The screw shafts 17A and 17B extend toward the other subframe 13A with their axial movement being regulated. When the projecting portions of the screw shafts 17A and 17B through the subframe 13B are manually rotated clockwise and counterclockwise, the suction units 10A, 10B, 10D, and 10E and discharge units 80A and 80C (to be described later) move in the directions of the arrows C and D.

The screw shafts 17A and 17B which support support members 25A, 25B, 25D, and 25E to be movable in the sheet widthwise direction are longitudinal feed inverse helical screws and each have a screw pitch that is larger on the outer side than on the inner side. A support member 25C which is located at the center has no threaded portion and does not move accordingly. Hence, the gap between a discharge unit 80 and suction unit 10 in the widthwise direction of the sheet 6 under conveyance is adjusted in accordance with the size of the sheet 6.

A rotating shaft 19 is rotatably supported between the pair of subframes 13A and 13B. When a motor (not shown) rotatably drives the rotating shaft 19 clockwise/counterclockwise, the subframes 13A and 13B move in the directions of the arrows A and B with respect to the pair of delivery frames 2 through pinions 20 and racks (not shown) axially mounted on the two ends of the rotating shaft 19. A sheet lay 21 which abuts against the trailing edge of the sheet 6 dropping onto the pile board 7 to align it has a large number of air vent holes 21*a* and is attached to the stay 14 to extend in the directions of the arrows C and D.

As shown in FIG. 3, blocks 22*a* each having one end supported by the stay 14 about a corresponding small shaft 23 as the swing center swingably support corresponding detection pieces 22 which detect the upward movement limit of the pile board 7. When the pallet 9 of the pile board 7 that has moved upward abuts against the detection pieces 22, the detection pieces 22 detect the pallet 9 to stop upward movement of the pile board 7. This prevents the pallet 9 from pushing up the suction units 10 or the like.

The suction units 10A to 10E and the support members 25A to 25E which support them will be described with reference to FIGS. 4 to 6. The suction units 10A to 10E and the support members 25A to 25E have the same basic structure. Hence, only the suction unit 10E and support member 25E will be described hereinafter, and the remaining suction units 10A to 10D and support members 25A to 25D will be described when necessary.

Figure 4:
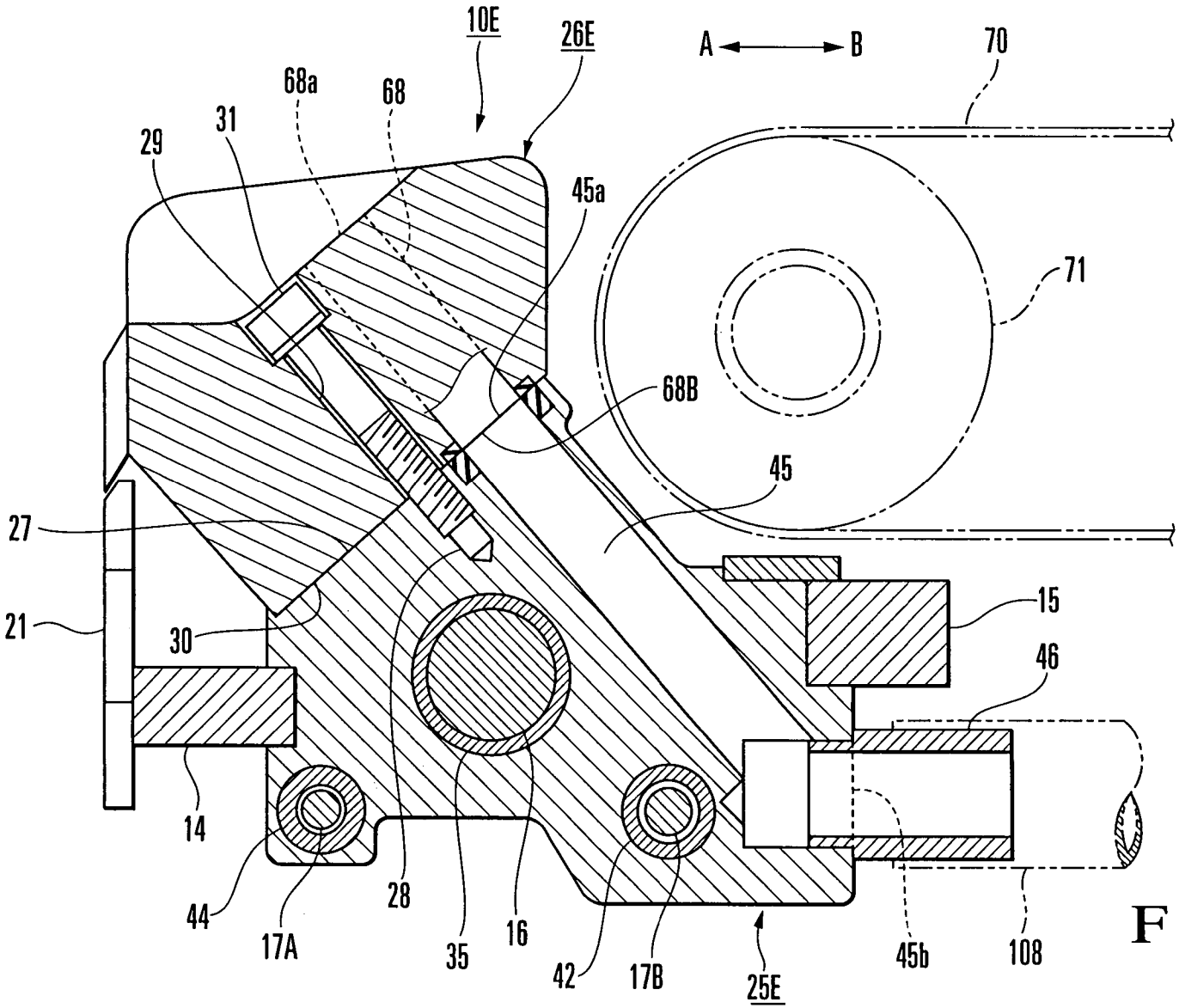
FIG. 4 is a sectional view taken along the line IV-IV of FIG. 2.

As shown in FIG. 4, the stays 14 and 15 support the flat block-like support member 25E to be movable in the widthwise direction (the directions of the arrows C and D) of the sheet 6 under conveyance. A screw hole 28 is threadably formed in an inclined upper mount surface 27 of the support member 25E. A flat block-like support target member 26E which forms the suction unit 10E is mounted on the inclined upper mount surface 27 of the support member 25E. The support target member 26E has a vertically extending insertion hole 29. A lower surface 30 of the support target member 26E is brought into contact with the mount surface 27 of the support member 25E. After that, a bolt 31 (engaging member) inserted in the insertion hole 29 is threadably engaged in the screw hole 28 (engaging target portion) to mount the support target member 26E on the support member 25E.

Figure 6:
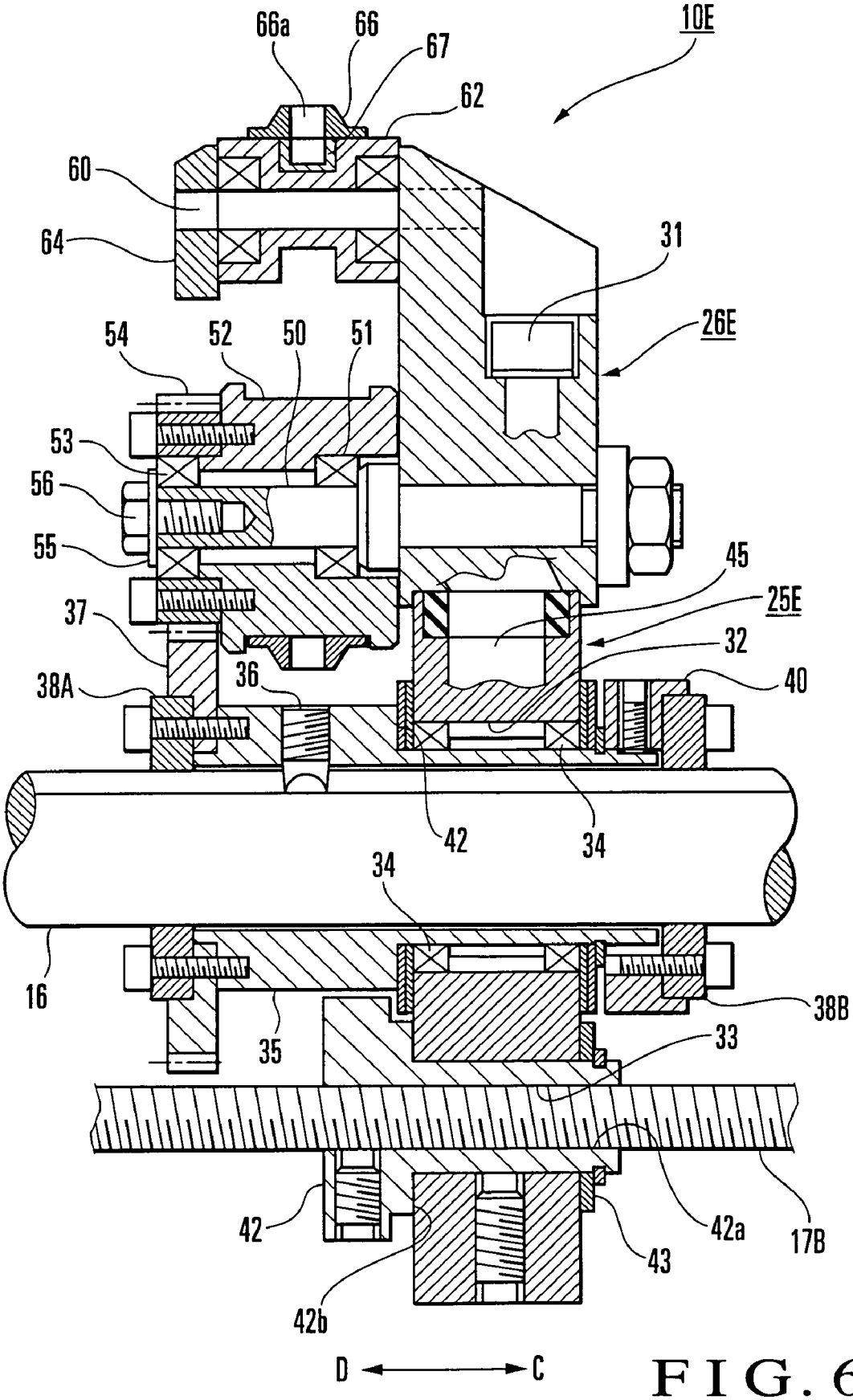
FIG. 6 is a sectional view taken along the line VI-VI of FIG. 5.

As shown in FIG. 6, the support member 25E has a large-diameter through hole 32 and two small-diameter through holes 33 (one through hole 33 is not shown). The diameter of the through hole 32 is larger than the diameter of the driving shaft 16 and incorporates a bearing 34. A sleeve 35 is fitted on the driving shaft 16. The sleeve 35 is rotatably supported in the through hole 32 of the support member 25E through the bearing 34. Fastening a set screw 36 allows to rotate the sleeve 35 together with the driving shaft 16. A ring-like slide member 38A fitted on the driving shaft 16 and one end face of the sleeve 35 sandwich a driving gear 37. The driving gear 37 is mounted on one end face of the sleeve 35 with bolts.

A coming-out preventive member 40 is mounted on the other end of the sleeve 35 with a set screw. The coming-out preventive member 40 and a step 35*a* formed on the sleeve 35 sandwich the support member 25E. Thus, when the support member 25E moves in the directions of the arrows C and D, the sleeve 35 moves together with the support member 25E. A slide member 38B fitted on the driving shaft 16 is mounted on the outer surface of the coming-out preventive member 40.

A substantially cylindrical moving element 42 having a threaded portion 42*a* to threadably engage with the screw shaft 17B is fitted in the through hole 33 of the support member 25E. A ring member 43 axially mounted on one end of the moving element 42 and a step 42*b* of the moving element 42 sandwich the support member 25E. When the moving element 42 moves in the directions of the arrows C and D, the support member 25E also moves together with the moving element 42 in the directions of the arrows C and D. As shown in FIG. 5, a moving element 44 having the same function as that of the moving element 42 threadably engages with the other screw shaft 17A. When the screw shafts 17A and 17B are rotated, the support member 25E moves together with the screw shafts 17A and 17B in the directions of the arrows C and D through the moving elements 42 and 44. As shown in FIG. 4, the support member 25E has an air passage 45 which extends between an upper end opening 45*a* in its upper surface and a lower end opening 45*b* in its side surface. A hose joint 46 is attached to the lower end opening 45*b*.

As shown in FIG. 6, a large-diameter pulley 52 is rotatably supported by a shaft 50, which extends upright on a support target member 26, through a bearing 51. A gear 54 is rotatably supported at the distal end of the shaft 50 through a bearing 53. The gear 54 is mounted on the upper end face of the large-diameter pulley 52 through bolts. A bolt 56 which threadably engages with the shaft 50 through a washer 55 regulates the gear 54 from coming out from the large-diameter pulley 52 and shaft 50.

Figure 5:
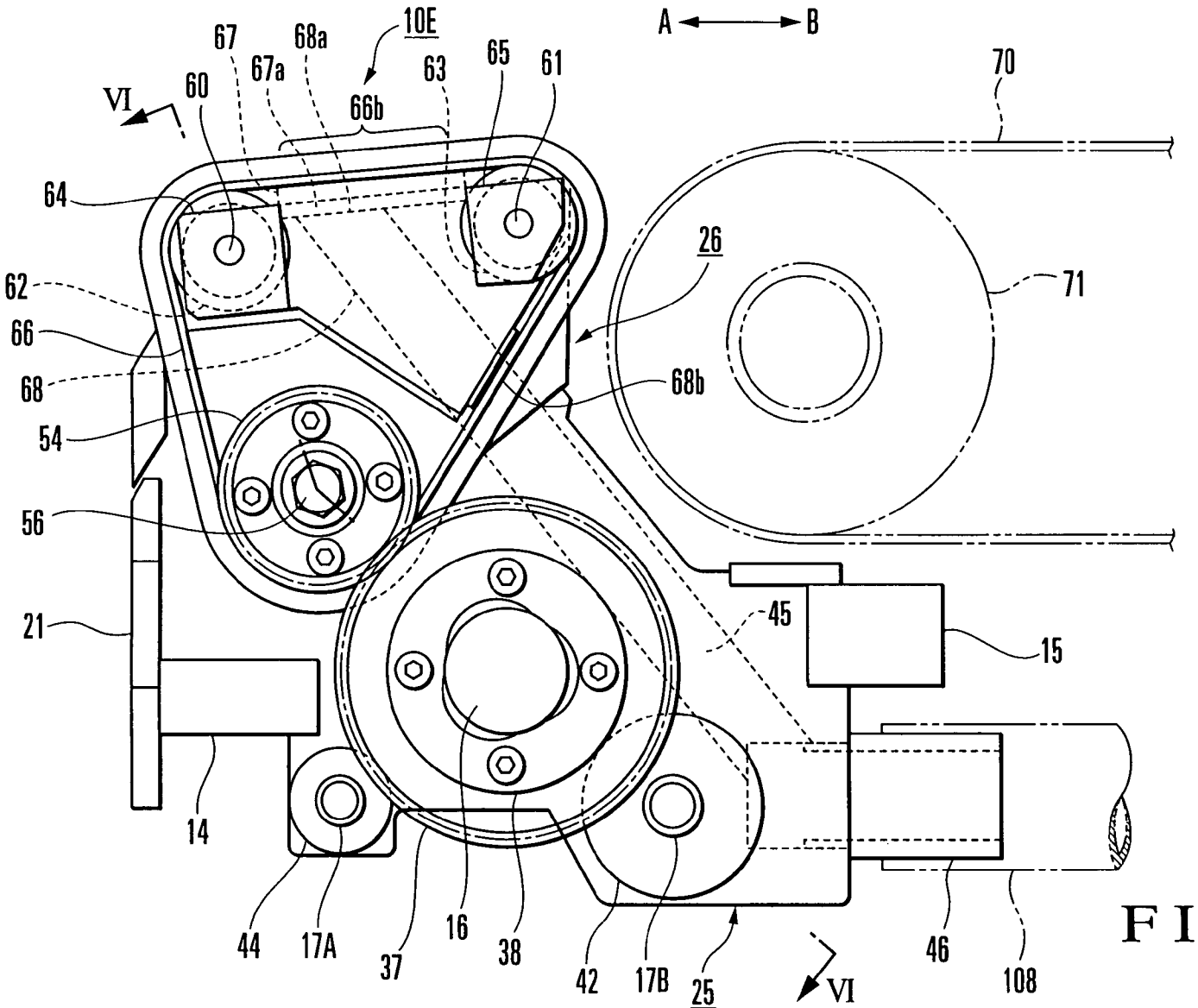
FIG. 5 is a view seen from the arrow V of FIG. 2.

As shown in FIG. 5, small-diameter pulleys 62 and 63 are rotatably supported by shafts 60 and 61, which extend upright in the upper portion of the support target member 26, through bearings. Coming-out preventive members 64 and 65 regulate the small-diameter pulleys 62 and 63 from coming out from the shafts 60 and 61. A suction belt 66 having a large number of suction ports 66*a* in its outer surface is looped among the small-diameter pulleys 62 and 63 and large-diameter pulley 52 to form a triangle.

As shown in FIG. 5, an air duct 67 is arranged between the small-diameter pulleys 62 and 63 to oppose the inner side of the suction belt 66. The air duct 67 has a U-shaped section such that its upper portion that opposes the suction belt 66 is open. When suction air from an intake source 101 (to be described later) is supplied to the air duct 67, that portion 66*b* of the suction belt 66 which opposes the air duct 67 forms a suction surface which draws by suction the sheet 6 under conveyance in slidable contact with it. An air passage 68 is formed under the air duct 67. The air passage 68 vertically extends through the support target member 26 so an upper end opening 68*a* and lower end opening 68*b* communicate with each other. The upper end opening 68*a* of the air passage 68 is connected to a communication hole 67*a* formed in the bottom of the air duct 67.

As described above, when the support target member 26E is mounted on the support member 25E, the upper end opening 45*a* of the air passage 45 comes into contact with the lower end opening 68*b* of the air passage 68, so the air passage 45 of the support member 25E communicates with the air passage 68 of the support target member 26E, as shown in FIG. 4. Simultaneously, the driving gear 37 of the support member 25E meshes with the gear 54 of the support target member 26E.

Figure 7:
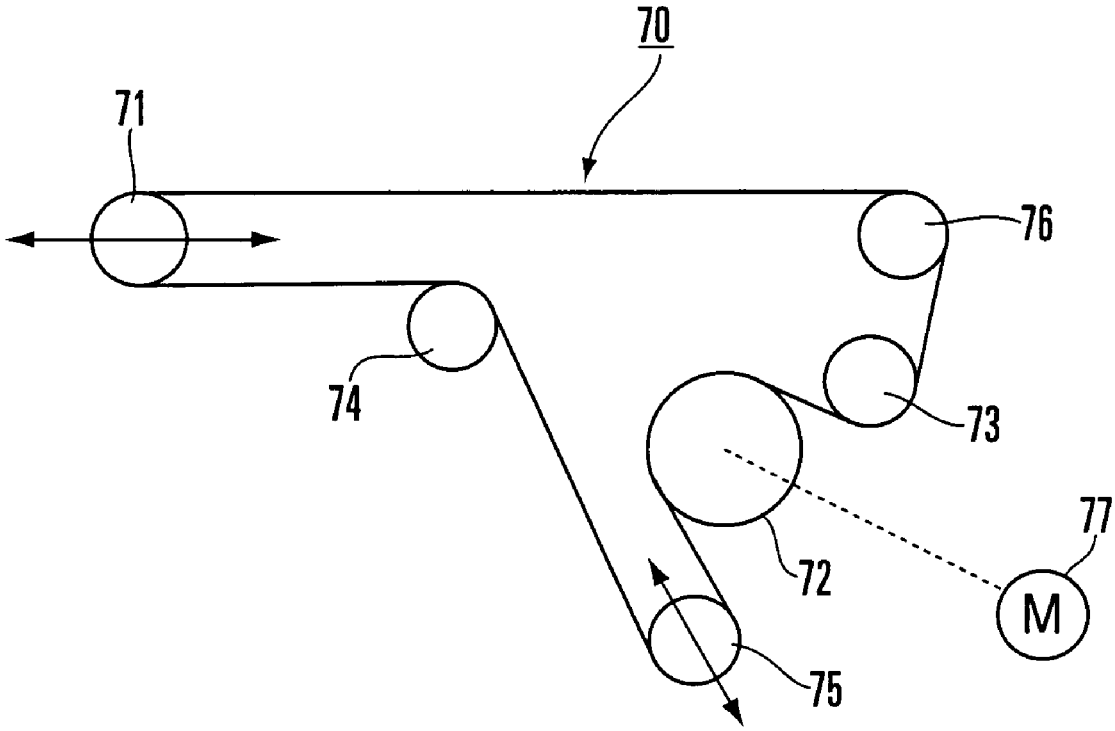
FIG. 7 is a view for explaining the looped state of a belt employed in the delivery device shown in FIG. 1.

A belt 70 which guides the sheet 6 gripped and conveyed by the grippers 5 is arranged below the delivery chains 4. As shown in FIG. 7, the belt 70 is looped among a driving roller 72, a tension roller 73, and driven rollers 71, 74, 75, and 76. In a sheet guide region between the driven rollers 71 and 76, the belt 70 is supported parallel to the delivery chains 4 and driven by a motor 77 (second driving source) which guides the driving roller 72 to travel at the same traveling speed as that of the delivery chains 4 through a reduction gear (not shown).

The guide unit will be described with reference to FIGS. 8 to 9. As shown in FIG. 9, a guide unit 80 comprises a block-like base 81 to be mounted on a support member 25, a pair of air blowing hollow bodies 82A and 82B to be mounted on the base 81, guide members 83A and 83B to be rotatably guided by the air blowing hollow bodies 82A and 82B, respectively, and a pair of rotation transmission bodies 84 which transmit rotation to the guide members 83A and 83B, respectively.

Figure 8:
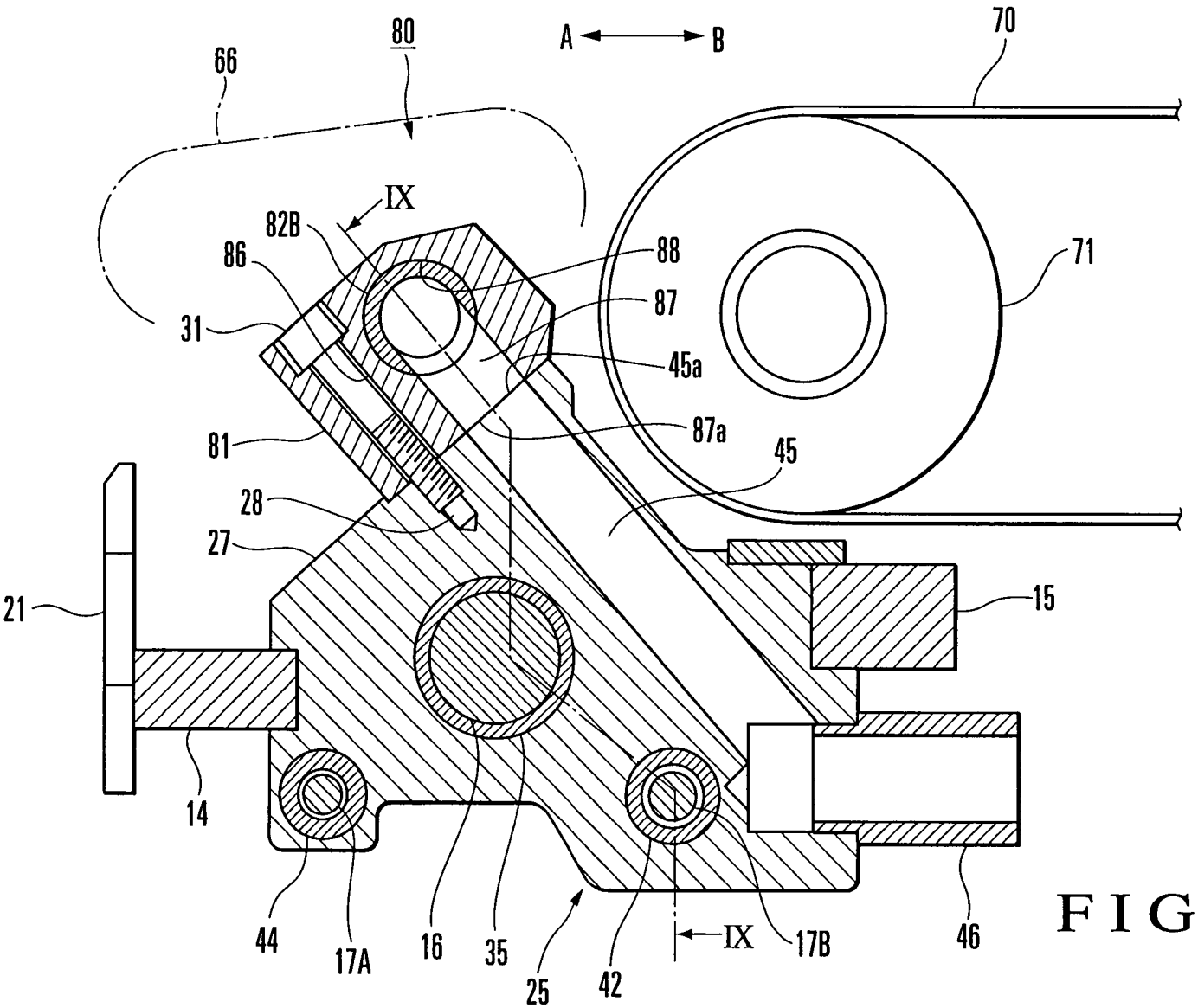
FIG. 8 is a sectional view showing a state wherein a guide unit employed in the delivery device shown in FIG. 1 is mounted on a support member.
Figure 9:
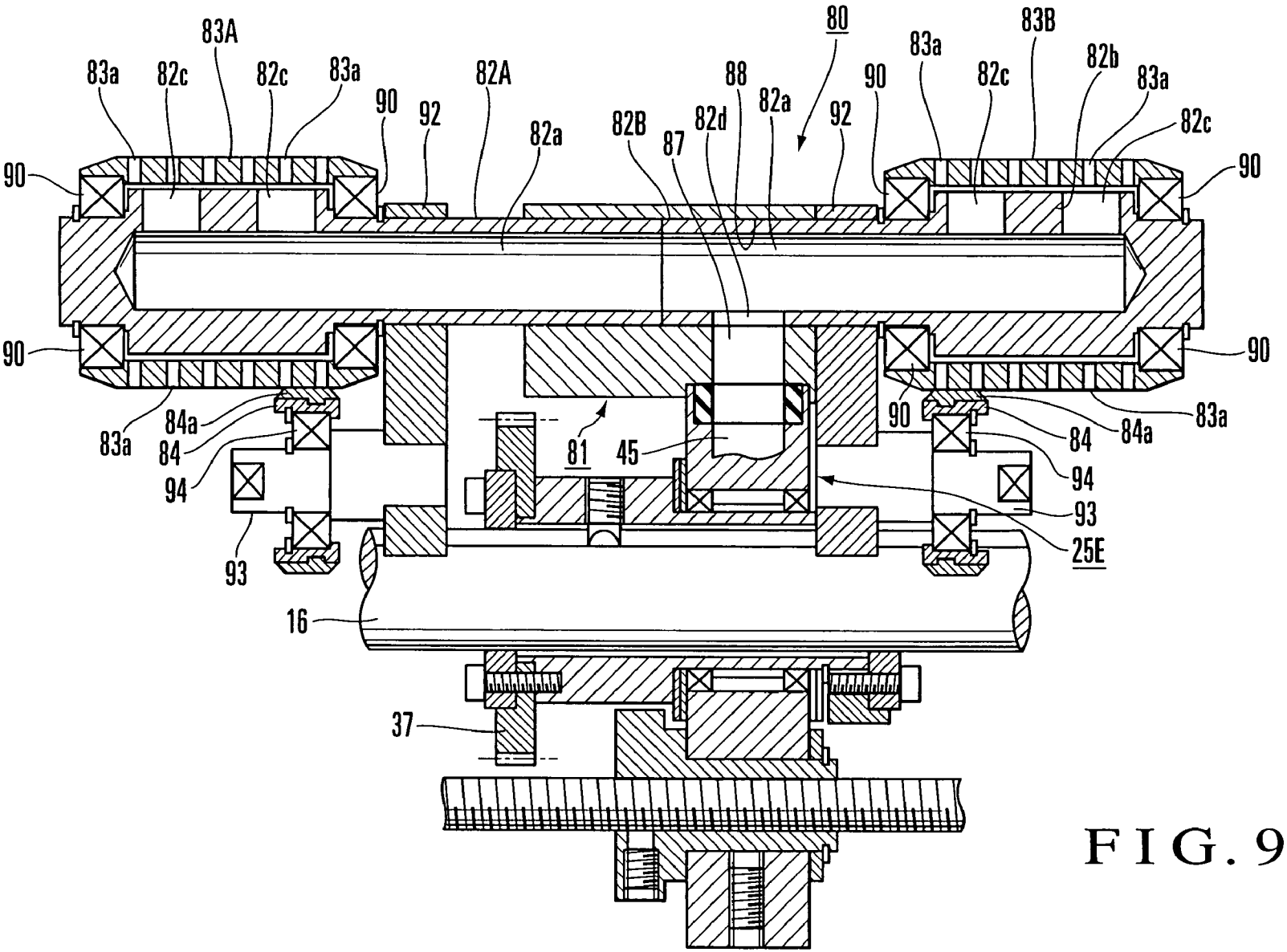
FIG. 9 is a sectional view taken along the line IX-IX of FIG. 8.

As shown in FIG. 8, the base 81 comprises an insertion hole 86 through which the bolt 31 is to be inserted, an air passage 87 having a lower end opening 87*a*, and a through hole 88 which communicates with the air passage 87 and extends through the base 81 in the sheet widthwise direction. After the lower surface of the base 81 is brought into contact with a mount surface 27 of the support member 25, the bolt 31 inserted in the insertion hole 86 is threadably engaged in the screw hole 28 of the support member 25 to mount the base 81 on the support member 25. When the base 81 is mounted on the support member 25, the lower end opening 87*a* of the air passage 87 comes into contact with the upper end opening 45*a* of the air passage 45, so the air passage 87 communicates with the air passage 45.

As shown in FIG. 9, each of the air blowing hollow bodies 82A and 82B substantially forms a bottomed cylinder having a hollow portion 82*a* with one open end, and has a thick-walled projecting portion 82*b* at its other end. Two communication holes 82*c* which connect the hollow portion 82*a* to the outside are formed in the upper portion of the projecting portion 82*b*. The air blowing hollow body 82B has, in part of its outer surface, a communication window 82*d* through which the hollow portion 82*a* communicates with the air passage 87 of the base 81. The air blowing hollow bodies 82A and 82B are mounted to be fitted in the through hole 88 of the base 81. At this time, the air blowing hollow body 82B is mounted such that the communication window 82*d* communicates with the air passage 87 of the base 81. The air blowing hollow body 82A is mounted such that its open end is in contact with that of the air blowing hollow body 82B. At this time, the hollow portion 82*a* of each of the air blowing hollow bodies 82A and 82B which communicate with each other is connected to the air passage 87 of the base 81 and the air passage 45 of the support member 25 through the communication window 82*d*.

Each of the cylindrical guide members 83A and 83B is supported at the other end of the corresponding one of the air blowing hollow bodies 82A and 82B to be rotatable about the corresponding projecting portion 82*b* through a bearing 90. The guide members 83A and 83B have a large number of small-diameter discharge ports 83*a* which extend from inside to the outside. Air from an air supply source 102 (to be described air) is discharged through, of the large number of discharge ports 83*a*, those which oppose the communication holes 82*c* of the air blowing hollow bodies 82A and 82B.

Figure 10:
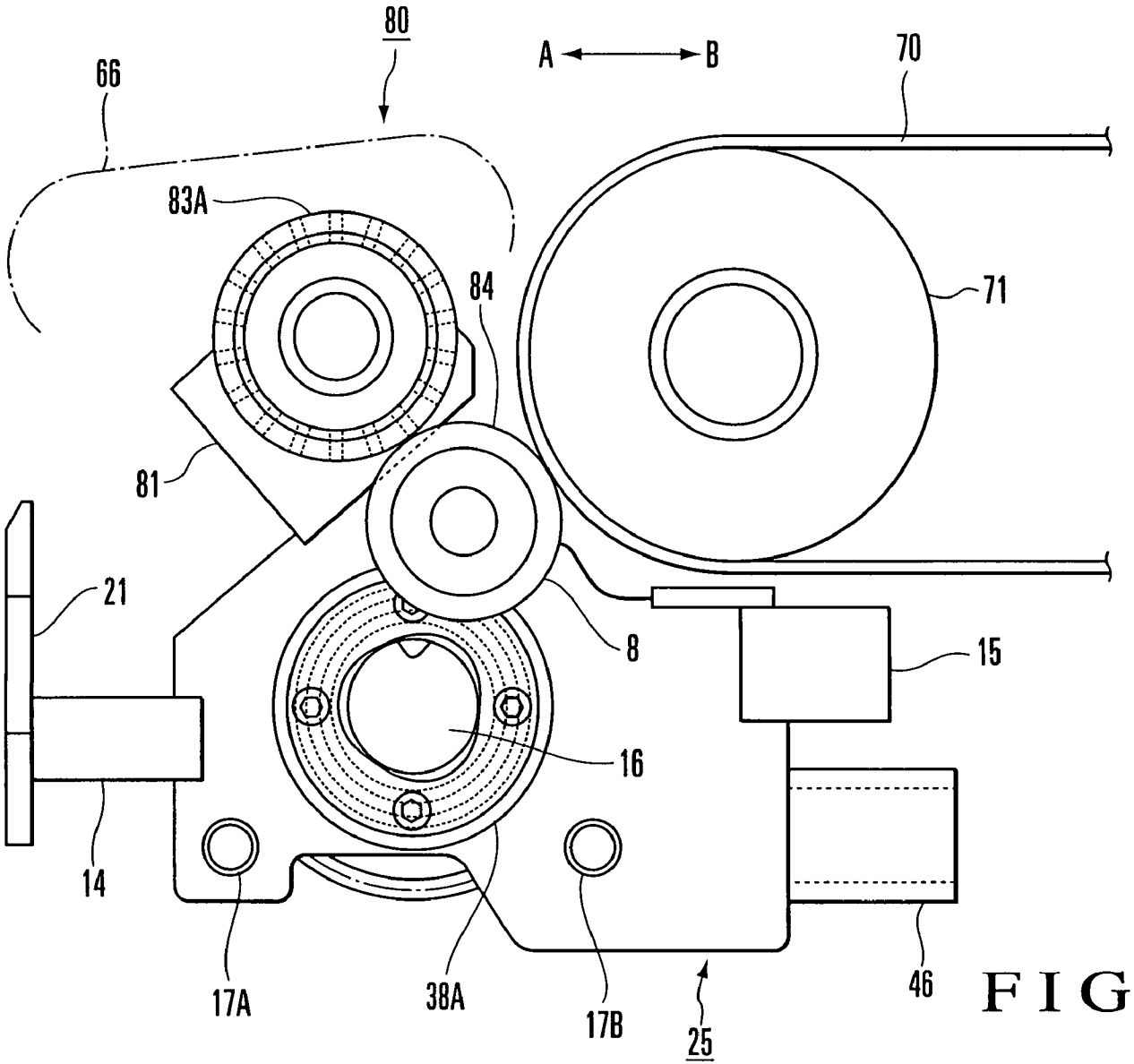
FIG. 10 is a side view showing a state wherein the guide unit employed in the delivery device shown in FIG. 1 is mounted on the support member.

One end of each of a pair of levers 92 is axially mounted on the corresponding one of the air blowing hollow bodies 82A and 82B, and each of a pair of shafts 93 is axially mounted on the other end of the corresponding lever 92. The rotation transmission bodies 84 are rotatably supported on the shafts 93 through bearings 94. Rubber-made contact portions 84*a* which come into contact with the guide members 83A and 83B are mounted on the outer surfaces the rotation transmission bodies 84, respectively. As shown in FIG. 10, the contact portions 84*a* also come into contact with the belt 70. Through frictional contact with the rotation transmission bodies 84, the guide members 83A and 83B rotate at the same peripheral speed as the traveling speed of the belt 70 in the same direction (counterclockwise in FIG. 10) as the sheet convey direction. The guide members 83A and 83B are arranged at positions slightly lower than the suction belt 66 of a suction unit 10.

Figure 11:
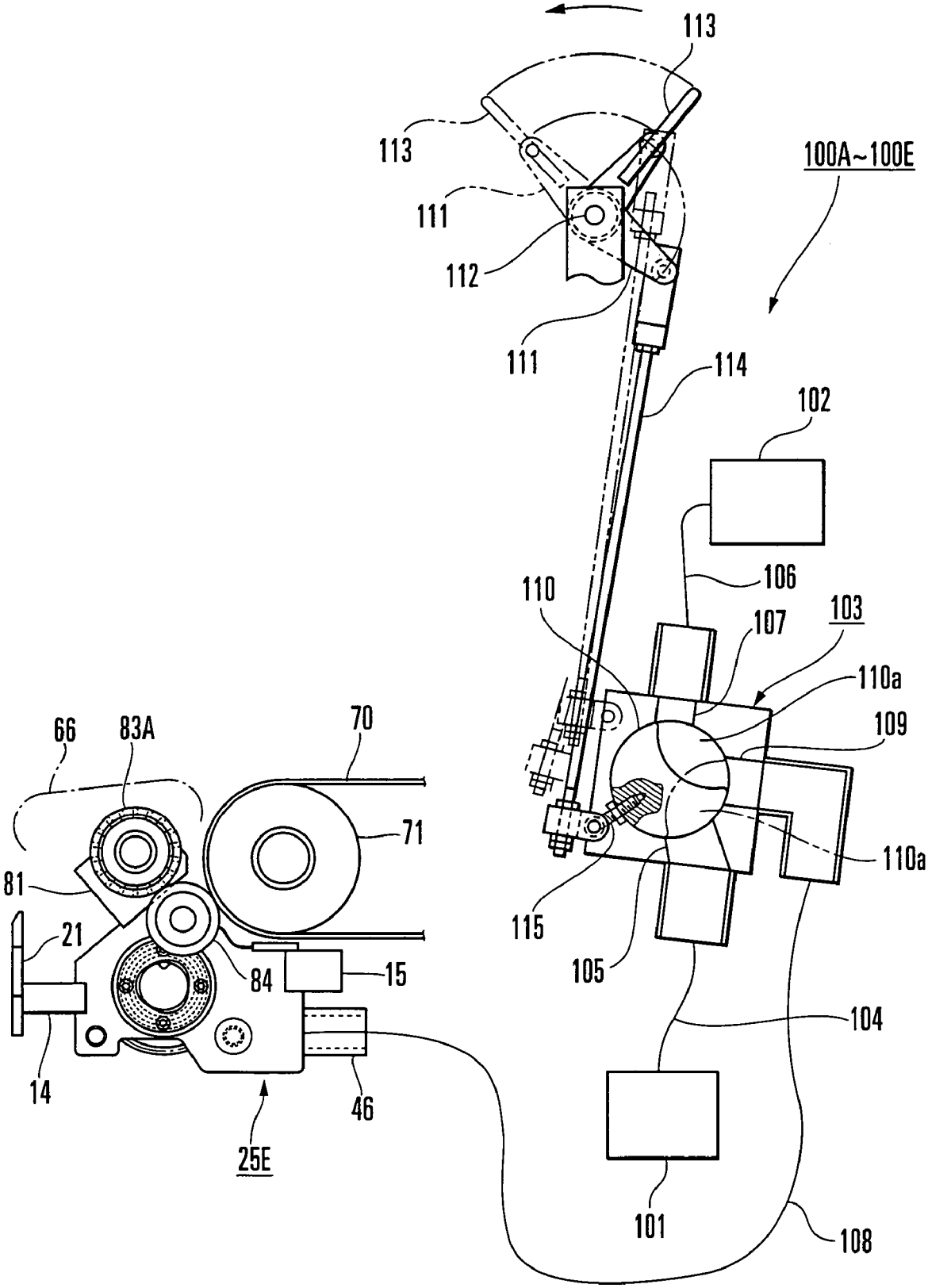
FIG. 11 is a view for explaining switching between an air intake/exhaust source and a suction/discharge unit in the delivery device shown in FIG. 1.

Five air supply devices 100A to 100E shown in FIG. 11 supply discharge air or suction air to the respective support members 25A to 25E. The air supply devices 100A to 100E share the one air intake source 101 which supplies suction air to the suction units 10A to 10E through the respective support members 25A to 25E. The air supply devices 100A to 100E also share one air exhaust source 102 which supplies discharge air to the air blowing boxes 80A to 80C through the support members 25A to 25E. The air intake source 101 and air exhaust source 102 are shared by the air supply devices 100A to 100E.

The air intake source 101 and air exhaust source 102 are connected to the air supply devices 100A to 100E through a switching device 103. The switching device 103 comprises an air intake passage 105 which is connected to the intake source 101 through a hose 104, an air blowing passage 107 which is connected to the air exhaust source 102 through a hose 106, an air supply passage 109 which is connected to the hose joint 46 through a common hose 108, and a switching valve 110 which selectively changes over the air passage 109 between the air passages 105 and 107.

The switching valve 110 has a notch 110*a* with a semilunar section. When the notch 110*a* is at the position indicated by an alternate long and two short dashed line in FIG. 10, the air passage 105 and air passage 109 communicate with each other through the notch 110*a*. When the notch 110*a* is at a position indicated by a solid line where it has been pivoted from the position indicated by the alternate long and two short dashed line by substantially 90°, the air passage 107 and air passage 109 communicate with each other through the notch 110*a*. An L-shaped lever 111 is swingably supported at its center about a shaft 112 extending upright from an apparatus fixing portion as the swing center. A manipulation lever 113 is attached to one end of the lever 111, and one end of a connection bar 114 is pivotally mounted on the other end of the lever 111. A switching bar 115 is provided to the switching valve 110. The distal end of the switching bar 115 is pivotally mounted on the other end of the connection bar 114.

Delivery operation in the delivery device having the above arrangement will be described. First, a case will be described when the convey speed of the sheet delivered by the suction units 10A to 10E is to be decreased. In this case, the support target members 26 are mounted on the mount surfaces 27 of the support members 25A to 25E of all the suction units 10A to 10E with the bolts 31, as shown in FIG. 4. In this state, the manipulation levers 113 of all the air supply devices 100A to 100E are pivoted counterclockwise, as indicated by the alternate long and two short dashed line in FIG. 11, to allow the air passages 105 and air passages 109 to communicate with each other.

Thus, suction air is supplied to the air passages 45 of the support members 25A to 25E of all the suction units 10A to 10E, and to the air passages 68 of support target members 26A to 26D and of the support target member 26E which communicate with the corresponding air passages 45. The suction air supplied to the air passages 68 is then supplied to the air ducts 67, so the sheet 6 under conveyance is drawn by suction by the suction surfaces 66*b* of the suction belts 66 which oppose the air ducts 67.

Referring to FIG. 6, when the motor 16*a* is driven to rotate the driving shaft 16, the sleeves 35 of the support members 25A to 25E rotate. As the sleeves 35 rotate, the driving gears 37 rotate together with them to rotate the gears 54 of the support target members 26A to 26E meshing with the driving gears 37. Thus, the large-diameter pulleys 52 rotate together with the gears 54, so the suction belts 66 looped among the corresponding large-diameter pulleys 52 and small-diameter pulleys 62 and 63 travel in the direction of the arrow A at a speed slightly lower than the convey speed of the sheet 6. At this time, the belts 70 (FIG. 5) are driven by motors (not shown) to travel in the direction of the arrow A at substantially the same speed as the traveling speed of the delivery chains 4.

The sheet 6 which is released from the gripper units 5 to drop at the convey terminal end of the delivery device 1 is drawn by suction at its trailing edge by the suction surfaces 66*b* of the five suction belts 66 to be in slidable contact with them. Thus, the traveling speed of the sheet 6 is decreased, so the sheet 6 is stacked on the pallet 9 on the pile board 7.

Assume that the delivery device is to be shifted from single-sided printing to double-sided, and the number of non-image portions is limited and non-image portions are not provided at the center in the widthwise direction of the sheet 6. In such a case, the three suction units 10B, 10C, and 10D cannot be arranged to be located at the center in the widthwise direction of the sheet 6 under conveyance. In this case, the three guide units 80 are provided in place of the suction units 10B, 10C, and 10D.

First, the bolts 31 that mount the support target members 26B, 26C, and 26D are loosened, and the suction units 10B, 10C, and 10D are removed together with the support target members 26B, 26C, and 26D from the support members 25B, 25C, and 25D. Subsequently, the guide units 80 are respectively mounted on the support members 25B, 25C, and 25D with the bolts 31.

In this state, the manipulation levers 113 of the air supply devices 100A and 100E are pivoted counterclockwise, as indicated by the alternate long and two short dashed line in FIG. 11, to allow the air intake passages 105 and air supply passages 109 to communicate with each other. Thus, suction air is supplied to the suction units 10A and 10E to supply the suction air to the suction belts 66 of the suction units 10A and 10E, respectively. Simultaneously, the manipulation levers 113 of the air supply devices 100B, 100C, and 100D are pivoted clockwise as indicated by the solid line in FIG. 11, to allow the air passages 107 and air passages 109 to communicate with each other.

Thus, discharge air is supplied to the air passages 45 of the support members 25B, 25C, and 25D, and to the air passages 87 of the guide units 80 that communicate with the air passages 45. The discharge air supplied to the respective air passages 87 is discharged from the discharge ports 83*a* of the guide members 83A and 83B included in the guide unit 80. When the motor 16*a* is driven to rotate the driving shaft 16, the suction belts 66 of the suction units 10A and 10E mounted on the support members 25A and 25E travel in the direction of the arrow A at a speed slightly lower than the convey speed of the sheet 6.

When delivery operation is performed in this state, the guide members 83A and 83B of each of the three guide units 80, which are arranged under the sheet 6 released from the gripper units 5 to drop at the convey terminal end of the delivery device 1, support and guide a sheet in the widthwise direction of the sheet. This prevents middle slack of the sheet 6, and the two ends of the sheet 6 will not disengage from the suction belts 66 of the suction units 10A and 10E, so that the convey speed of the sheet 6 can be decreased sufficiently. As a result, fluttering of the sheet 6 is prevented reliably, and misalignment of the edge of the sheet when stacked can be prevented, and the sheet can be prevented from coming into contact with the brackets of the suction wheels, so its printing surface will not be damaged. As the guide members 83A and 83B which guide the sheet 6 rotate at substantially the same speed as the convey speed of the sheet 6 in the same direction as the convey direction of the sheet 6, the guide members 83A and 83B will not damage the printing surface.

Air is discharged from the discharge ports 83*a* of the guide members 83A and 83B through the air passages 45 and 87 and the air blowing hollow bodies 82A and 82B toward the lower surface of the sheet 6 under conveyance to float the sheet 6. Thus, middle slack of the sheet 6 can be prevented reliably. The sheet 6 which is released from the gripper units 5 to drop at the convey terminal end of the delivery device 1 is drawn by suction at its trailing edge by the suction surfaces 66*b* of the suction units 10A to 10E to be in slidable contact with them. Thus, the traveling speed of the sheet 6 is decreased, so the sheet 6 is reliably stacked on the pallet 9 on the pile board 7.

As described above, the suction units 10B to 10D and guide units 80 can be selectively mounted on the support members 25B to 25D. No guide unit 80 need be provided in advance independently of the suction units, thus simplifying the structure. Both the mounting structures of the suction units 10B to 10D with respect to the support members 25B to 25D and the mounting structures of the guide units 80 with respect to the support members 25B to 25D employ the bolts 31. Thus, two types of mounting structures are not needed, so the structure can be simplified and the number of components can be decreased. The switching device 103 is provided which switches air supply from the air intake source 101/air exhaust source 102 to the suction unit 10/discharge unit 80. Thus, air can be supplied to the suction unit 10 and discharge unit 80 with the common hose 108, so the structure can be simplified and the number of components can be decreased.

The second embodiment of the present invention will be described with reference to FIGS. 12 and 13. As shown in FIG. 13, shafts 124 and 125 horizontally extend between a pair of side plates 121 and 122 standing upright on a bottom plate 123 to oppose each other. A guide member 127 is rotatably supported by the shaft 124 through bearings 126, and a rotation transmission body 129 is rotatably supported by the shaft 125 through bearings 128. A rubber-made contact portion 129*a* which comes into contact with the guide member 127 is mounted on the outer surface of the rotation transmission body 129.

Figure 12:
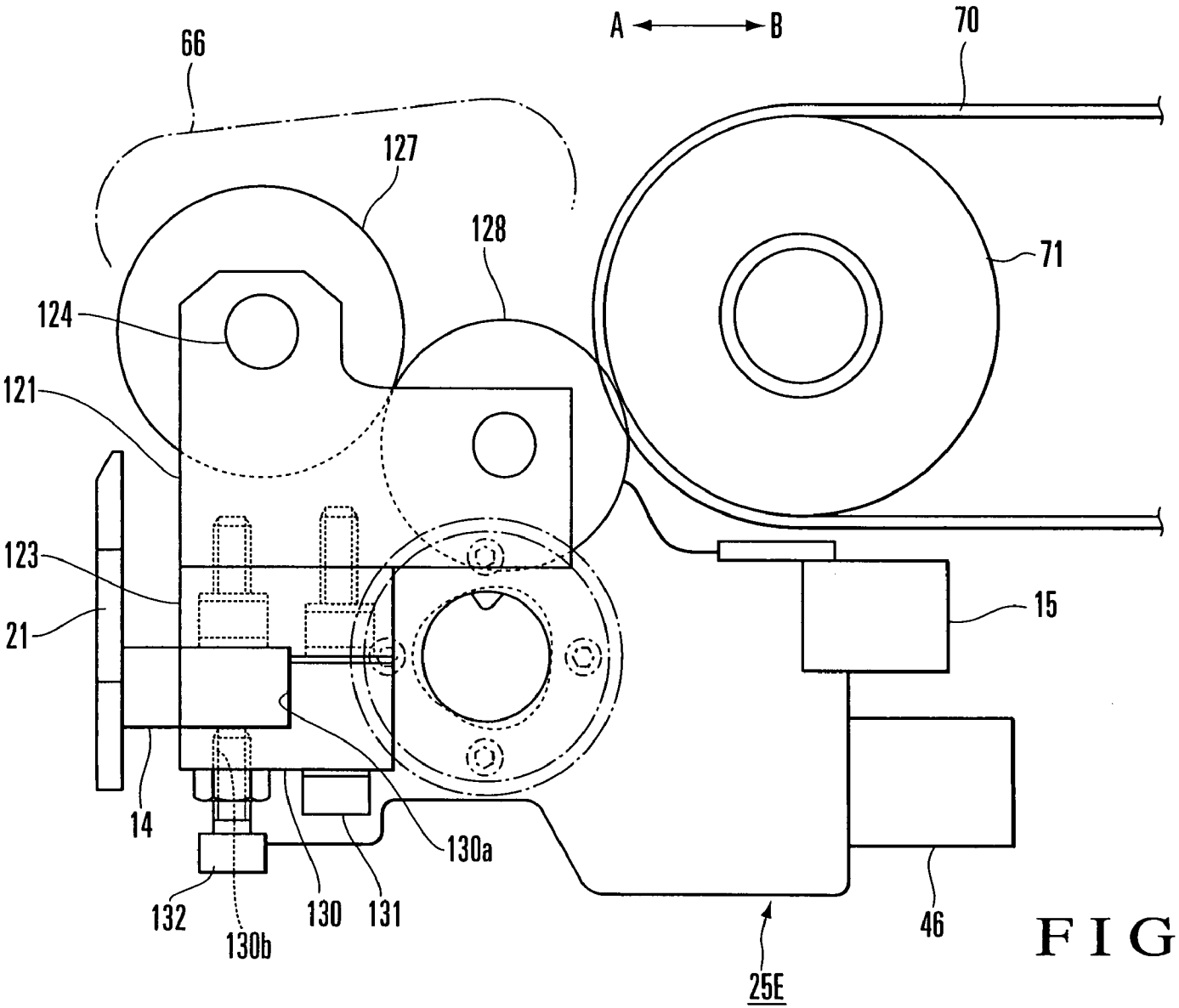
FIG. 12 is a side view showing the main part of a delivery device according to the second embodiment of the present invention.
Figure 13:
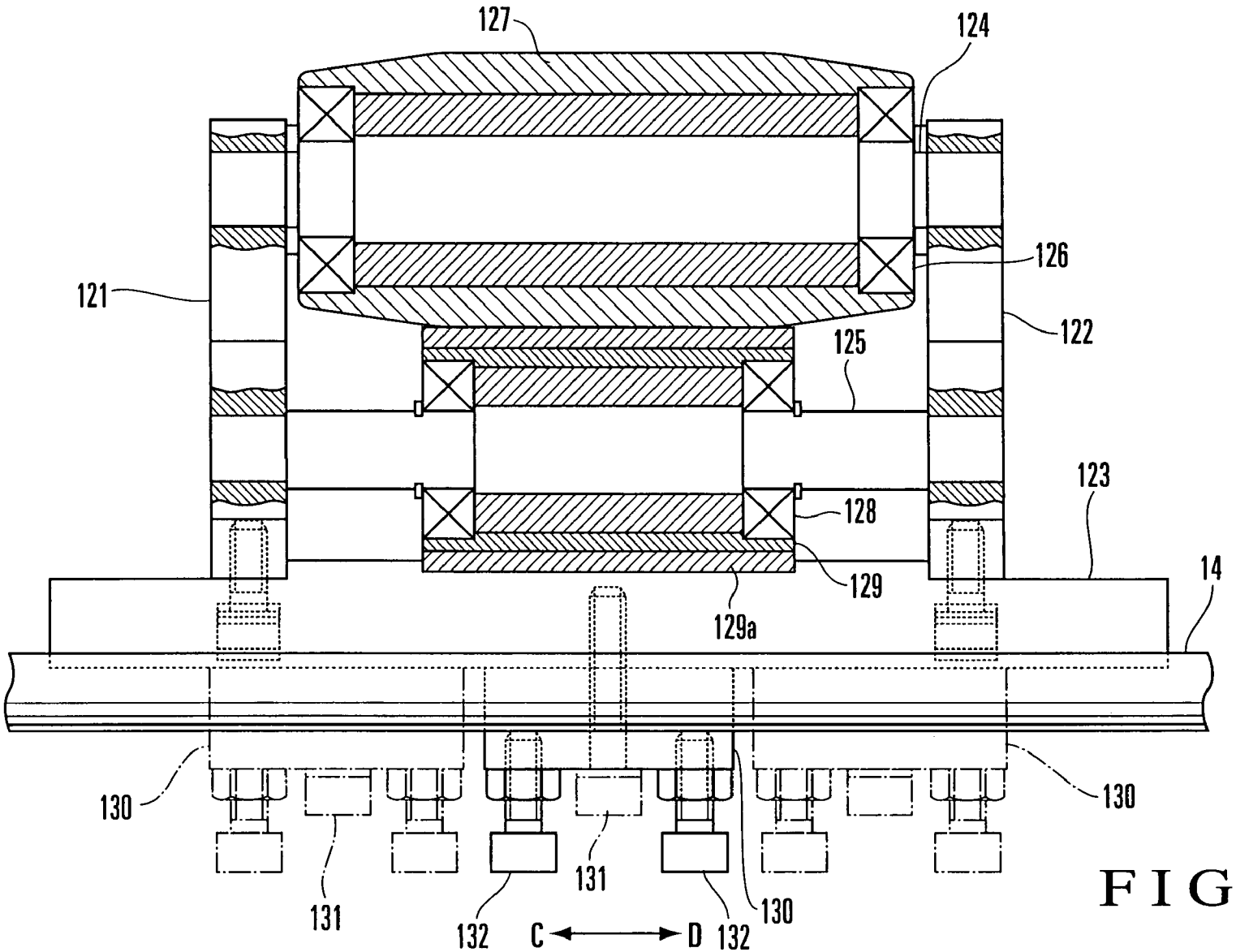
FIG. 13 is a sectional view taken along the line XIII-XIII of FIG. 12.

As shown in FIG. 12, a holding block 130 having an L-shaped section is mounted on the bottom plate 123 with a bolt 131. A groove 130*a* is formed between the bottom plate 123 and holding block 130. A screw hole 130*b* communicating with the groove 130*a* which engages with a stay 14 is formed in the bottom of the bottom plate 123. After the groove 130*a* is fitted with the stay 14 between support members 25A and 25E, the distal end of a bolt 132 threadably engaging in the screw hole 130*b* is abutted against the stay 14 to mount the bottom plate 123 on the stay 14. Thus, one or more guide members 125 are positioned between suction units 10A and 10E at the two ends independently of support members 25B, 25C, and 25D, and arranged below suction belts 66, as shown in FIG. 12. At this time, the contact portion 129*a* of the rotation transmission body 129 comes into contact with a belt 70.

In this arrangement, suction units 10B, 10C, and 10D other than the suction units 10A and 10E at the two ends are removed from the support members 25B, 25C, and 25D, respectively. Subsequently, suction air is supplied to the suction units 10A and 10E supported by the support members 25A and 25E, respectively, and a motor 16*a* drives the suction belts 66 of the suction units 10A and 10E to travel at a speed slightly lower than the convey speed of a sheet 6. In this state, when the sheet 6 is released from grippers 5 at the convey terminal end of a delivery device 1 to drop, the sheet 6 is guided in the sheet convey direction as its central portion is supported by the guide member 127 arranged below the sheet 6. This can prevent middle slack of the sheet 6.

According to this embodiment, as the two ends of the sheet 6 will not disengage from the suction belts 66 of the suction units 10A and 10E, the convey speed of the sheet 6 can decrease sufficiently. Thus, the sheet 6 will not flutter, so misalignment of the edge of the sheet when stacked can be prevented, and the sheet can be prevented from coming into contact with the brackets of the suction units, so its printing surface will not be damaged. As the guide member 127 which guides the sheet 6 rotates at substantially the same speed as the convey speed of the sheet 6 in the same direction as the convey direction of the sheet 6, the guide member 127 will not damage the printing surface. The guide member 127 can be moved and adjusted in directions of arrows C and D by loosening the bolt 132 and moving the holding block 130 in the longitudinal direction of the stay 14. Two or more guide members 127 can be provided when necessary.

In the first embodiment described above, air is discharged from the guide members 83A and 83B. If the sheet 6 need not be suspended from the guide members 83A and 83B, air discharge is unnecessary. The sheet suffices as far as it is a sheet-type object.

As has been described above, according to the present invention, since the guide member which guides at substantially the same speed as the convey speed of the sheet under conveyance is provided, middle slack of the sheet can be prevented without damaging the sheet. As air need not be blown to the sheet, the air blowing amount need not be adjusted.

The suction units and discharge units can be selectively mounted on the support members. Thus, no discharge units need be provided in advance independently of the suction units, so the structure can be simplified. Since the sheet is suspended from the guide member by air discharged from the discharge units, middle slack of the sheet can be prevented reliably.

As air can be supplied to the suction units and discharge units through common pipes, the structure can be simplified and the manufacturing cost can decrease.

What is claimed is:

1. A delivery device in a sheet-fed offset rotary printing press, comprising:

a plurality of suction units which are arranged on an upstream sheet convey direction side above a pile board and below a sheet under conveyance in a widthwise direction of the sheet and which draw by suction the sheet under conveyance in slidable contact therewith; and at least one guide unit arranged between suction units among said plurality of suction units, wherein said suction units comprise suction wheels which are rotatably driven at a peripheral speed lower than the convey speed of the sheet upon drawing the sheet under conveyance by suction, and said guide unit comprises a guide member which is rotatably driven at substantially the same peripheral speed as the convey speed of the sheet and supports the sheet under conveyance.

2. A device according to claim 1, further comprising at least one support member on which a suction unit among said plurality of suction units, and said guide unit are selectively mounted.

3. A device according to claim 2, further comprising a first driving source which drives said suction wheel when said suction wheel is mounted on said support member, and a second driving source which rotatably drives said guide member when said guide unit is mounted on said support member.

4. A device according to claim 2, wherein said guide member comprises air blowing means for discharging air toward a lower surface of the sheet under conveyance to guide the sheet.

5. A device according to claim 4, further comprising air switching means for supplying suction air to said suction wheel when said suction wheel is mounted on said support member and supplying discharge air to said air blowing member when said guide unit is mounted on said support member.

6. A device according to claim 5, wherein said air switching means is provided to correspond to one of said plurality of suction units.

7. A device according to claim 6, further comprising a manipulation portion which switches said air switching means when said one suction unit among said plurality of suction units is replaced by a discharge unit.

8. A device according to claim 7, wherein said air switching means comprises an air intake source which supplies suction air to said suction units, an air exhaust source which supplies discharge air to said discharge unit, and a switching valve which switches a first air passage connected to said suction and discharge units between a second air passage connected to said air intake source and a third air passage connected to said air exhaust source.

9. A device according to claim 7, wherein said support member comprises a plurality of support members arranged in a widthwise direction of the sheet, and said plurality of support members selectively support said suction and discharge units.

10. A device according to claim 4, wherein said guide member comprises a cylindrical hollow body including a hollow portion to which discharge air is supplied, and a plurality of discharge ports formed in an outer surface of said hollow body and communicate with said hollow body.

11. A device according to claim 10, wherein said guide member further comprises at least one communication hole which communicates from an interior of said hollow body upwardly to said discharge ports, and said hollow portion blows air toward the sheet under conveyance through said communication hole and said discharge ports.

12. A device according to claim 2, further comprising a mounting structure with which one of said suction units and said guide unit are commonly mounted on said corresponding support member.

13. A device according to claim 12, wherein said mounting structure comprises an engaging target portion provided to said support member, and an engaging member which engages with said engaging target portion, said engaging member serving to engage with said engaging target portion to selectively fix said one suction unit among said plurality of suction units and said guide unit to said support member.

14. A device according to claim 13, wherein said engaging target portion comprises a screw hole formed in said support member, and said engaging member comprises a bolt which is to be threadably engaged in said screw hole through insertion holes formed in said suction unit among said one suction unit and in said guide unit.

15. A device according to claim 2, wherein said support member comprises a screw hole and a first opening between said one suction unit and said guide unit, said one suction unit comprises a first insertion port and second opening which correspond to said screw hole and first opening of said support member, and said discharge unit comprises a second insertion port and third opening which correspond to said screw hole and first opening of said support member.

16. A device according to claim 2, further comprising a screw shaft which is supported by a frame and supports said support member to be movable in the widthwise direction of the sheet, wherein when said screw shaft is operated, said support member is moved depending on a sheet size.

17. A device according to claim 2, wherein said support member is supported by a stay, supported by a pair of frames arranged to oppose each other, to be movable in a direction perpendicular to the convey direction of the sheet, said suction unit is detachably supported by said support member, and said guide unit is detachably supported by said stay.

18. A device according to claim 17, further comprising a first driving source which drives said suction wheel when said suction unit is mounted on said support member, and a second driving source which rotatably drives said guide member when said guide unit is mounted on said stay.

19. A device according to claim 1, further comprising convey means for conveying the sheet, driving means for driving said convey means, and a rotation transmission body which is rotatably driven by said driving means, wherein said guide member is rotatably driven by said rotation transmission body.

20. A device according to claim 19, wherein said rotation transmission body is arranged to come into contact with an outer surface of said guide member, and said guide member is rotatably driven by frictional contact with said rotation transmission body.

21. A delivery device in a sheet-fed offset rotary printing press, comprising:

a plurality of suction units which are arranged on an upstream sheet convey direction side above a pile board and below a sheet under conveyance in a widthwise direction of the sheet and which draw by suction the sheet under conveyance in slidable contact therewith; and at least one guide unit which is arranged between suction units among said plurality of suction units, wherein a guide surface of said guide unit which guides the sheet is arranged at a height lower than a suction surface of said suction unit which draws the sheet by suction.

22. A delivery device in a sheet-fed offset rotary printing press, comprising:

a plurality of suction units which are arranged on an upstream sheet convey direction side above a pile board and below a sheet under conveyance in a widthwise direction of the sheet and which draw by suction the sheet under conveyance in slidable contact therewith; and at least one guide unit which is arranged between suction units among said plurality of suction units, wherein said suction units comprise suction wheels.

23. A device according to claim 22, wherein said suction wheels comprise belt type suction wheels.

24. A device according to claim 22, wherein said suction units include suction surfaces which draw by suction the sheet under conveyance to be in slidable contact therewith.

25. A delivery device in a sheet-fed offset rotary printing press, comprising:

a plurality of suction units which are arranged on an upstream sheet convey direction side above a pile board and below a sheet under conveyance in a widthwise direction of the sheet and which draw by suction the sheet under conveyance in slidable contact therewith; and at least one guide unit which is arranged between suction units among said plurality of suction units, wherein said suction units each comprises a suction belt which travels at a speed lower than the convey speed of the sheet and attracts by suction the sheet under conveyance.

* * * * *